US006247384B1

(12) United States Patent
Kusu et al.

(10) Patent No.: US 6,247,384 B1
(45) Date of Patent: Jun. 19, 2001

(54) FASTENING DEVICE

(75) Inventors: Takuya Kusu; Masahiro Takamura; Takahiro Tokunaga, all of Kumamoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/499,370

(22) Filed: Feb. 7, 2000

(30) Foreign Application Priority Data

Feb. 8, 1999 (JP) ..... 11-030459

(51) Int. Cl.[7] ..... B25B 13/00
(52) U.S. Cl. ..... 81/54; 81/57.42
(58) Field of Search ..... 81/54, 55, 57.36, 81/57.42

(56) References Cited

U.S. PATENT DOCUMENTS 2,533,703 * 12/1950 Wilhide et al. ..... 81/464
5,024,565 * 6/1991 Pinand ..... 408/121
5,964,128 * 10/1999 Kaneyama et al. ..... 81/56
5,970,824 * 10/1999 Thompson et al. ..... 81/54

FOREIGN PATENT DOCUMENTS 1 469 801 * 4/1977 (GB) ..... 81/57.42
000 8046 * 1/1983 (JP) ..... 81/57.42
2-12049B 5/1985 (JP) .

* cited by examiner

*Primary Examiner*—James G. Smith
*Assistant Examiner*—Hadi Shakeri
(74) *Attorney, Agent, or Firm*—Birch, Stewart, Kolasch & Birch LLP

(57) ABSTRACT

In a fastening device, to an impact wrench body 2 of an impact wrench 1 a jig holder 5 is detachably fitted. To this jig holder 5 a socket integrated type whirl-stop jig 6 is detachably fitted. The socket integrated type whirl-stop jig 6 is constituted by a whirl-stop jig body 7 which is detachably fitted to a jig holder 5, a socket 8 which is rotatably supported on the jig body 7, and a coupling member 13. The socket 8 and the coupling member 13 are connected to be relatively movable in an axial direction and rotatable in one-piece with each other. The coupling member 13 is connected with the rotary shaft 20 of the impact wrench 1, and a fastener 28 is engaged with the socket 8 to be tightened to the screw 37 of the rotary shaft 36 to which the clutch inner part 33 is fitted. The whirl-stop jig body 7 has a one-piece whirl-stop part 32, which is engaged with the rib 34 of the clutch inner part 33, to whirl-stop the clutch inner part 33.

6 Claims, 3 Drawing Sheets

FASTENING DEVICE

BACKGROUND OF THE INVENTION

1. Field of the Invention

The present invention relates to a fastening device to be used for the fastening work of a rotary member such as for fixing a flywheel to a crankshaft of an engine with a nut.

2. Description of the Prior Art

The fastening device as described above is known. In the Utility Model Publication No. HEI2-12049, a whirl-stop pin is integrally provided with an impact wrench body (case side), and this whirl-stop pin is engaged to a preset hole of a flywheel fitted to the shaft end of a crankshaft to baffle the flywheel. Further, a nut or bolt provided at the tip of a rotary shaft of the impact wrench is fastened to the shaft end of the crankshaft so as to fix the flywheel.

When the system is constituted as above, the fastening work and the whirl-stop work are simultaneously performed with a single device, so that the flywheel which is rotatable in one-piece with the rotary shaft does not need to be whirl-stopped by a detent tool other than the impact wrench. Thus, the device provides excellent workability.

According to the conventional system as above, however, because the whirl-stop pin is fixed to the impact wrench body, the fastening device can not be used when the whirl-stop detaining position changes due to the difference of objects to be fixed, with the result that such device becomes a tool for exclusive use without having universal applicability. Accordingly, the present invention has its object to provide the fastening device with universal applicability so as to be commonly usable for various kinds of objects to be fixed.

SUMMARY OF THE INVENTION

In order to solve the above subject, according to the first aspect of the invention, a fastening device in which a member to be fixed is engaged with a shaft end of a rotary shaft and fixed thereto by a fastener, comprises a fastener driving means having a rotary driving part and a driving body which rotatably supports the rotary driving part, and a whirl-stop jig which is integrally provided with a socket, the whirl-stop jig having a tubular jig body detachably fitted to the driving body and the socket rotatably supported in the tubular jig body, a whirl-stop jig body provided with a whirl-stop for holding the member to be fixed in a non-rotational manner, and the socket cooperatively connected at an end thereof to the rotary driving part to rotate therewith and provided on the other end thereof with a coupling portion for the fastener.

In the second aspect of the invention, the socket is connected to a rotary driving shaft of the rotary driving part through a coupling member. The coupling member and the socket are connected in a manner to be rotatable en bloc and relatively movable in an axial direction, and the socket is forced to project forward by a spring interposed between the coupling member and another end.

In the third aspect of the invention, the whirl-stop jig body is fitted to a jig holder which is previously fitted to the driving body in a freely rotatable manner, and a reaction force receiving part for receiving the reaction force of the fastener driving means is provided on the jig holder.

In the fourth aspect of the invention, the whirl-stop has a pin form which is engaged with an engaging hole provided on the member to be fixed.

In the fifth aspect of the invention, the whirl-stop is formed into a concave part in which a convex part provided on the member to be fixed is engaged.

In the sixth aspect of the invention, the whirl-stop is formed to be engaged with a rib provided on the member to be fixed.

In the seventh aspect of the invention, the whirl-stop is formed into a hollow member in which serration is provided on the inner surface.

According to the invention, because the whirl-stop jig is freely detachable from the fastener drive means, in case of the change of the object to be fixed, it can be replaced with a socket one-piece type jig suitable for the whirl-stop structure, so that the fastening structure suited to universal applicability can be provided.

The socket is connected to the rotary driving part through a coupling member, and the coupling member and the socket are connected in a manner to be rotatable in one-piece and relatively movable in the axial direction and the socket is forced to project forward by the spring. Accordingly, even if the position of the fastener such as a nut or bolt changes during the fastening work, the socket can favorably follow the change. Moreover, as it is possible to meet any change of the axial end position of the rotary shaft which is a subjective part of fastening and universal applicability of use to some extent can be obtained.

The whirl-stop jig body is fitted to the driving body in a freely rotatable manner, and the reaction force receiving part for receiving the reaction force of the fastener driving means is provided on the jig holder. Accordingly, when the reaction force is transmitted to a coupling region between the jig holder and the whirl-stop jig body from the socket at the time of completion of the fastening operation, it can be received there by the reaction force receiving part. When the whirl-stop has the pin form, whirl-stopping may be easily performed through an engaging hole provided on the member to be fixed.

Alternatively when the whirl-stop is formed into the concave part, whirl-stopping may be made easily with respect to the member having the convex part.

When the whirl-stop is formed to be engaged with the rib provided on the member to be fixed, whirl-stop may be easily made with respect to the member having the rib.

Further, in the case where the whirl-stop is formed with the hollow member on the inner surface of which serration is provided, when the member to be fixed has an engageable angular part such as a gear, whirl-stopping may be made by engaging the whole of the member into the hollow part.

DESCRIPTION OF THE PREFERRED EMBODIMENTS

Figure 1:
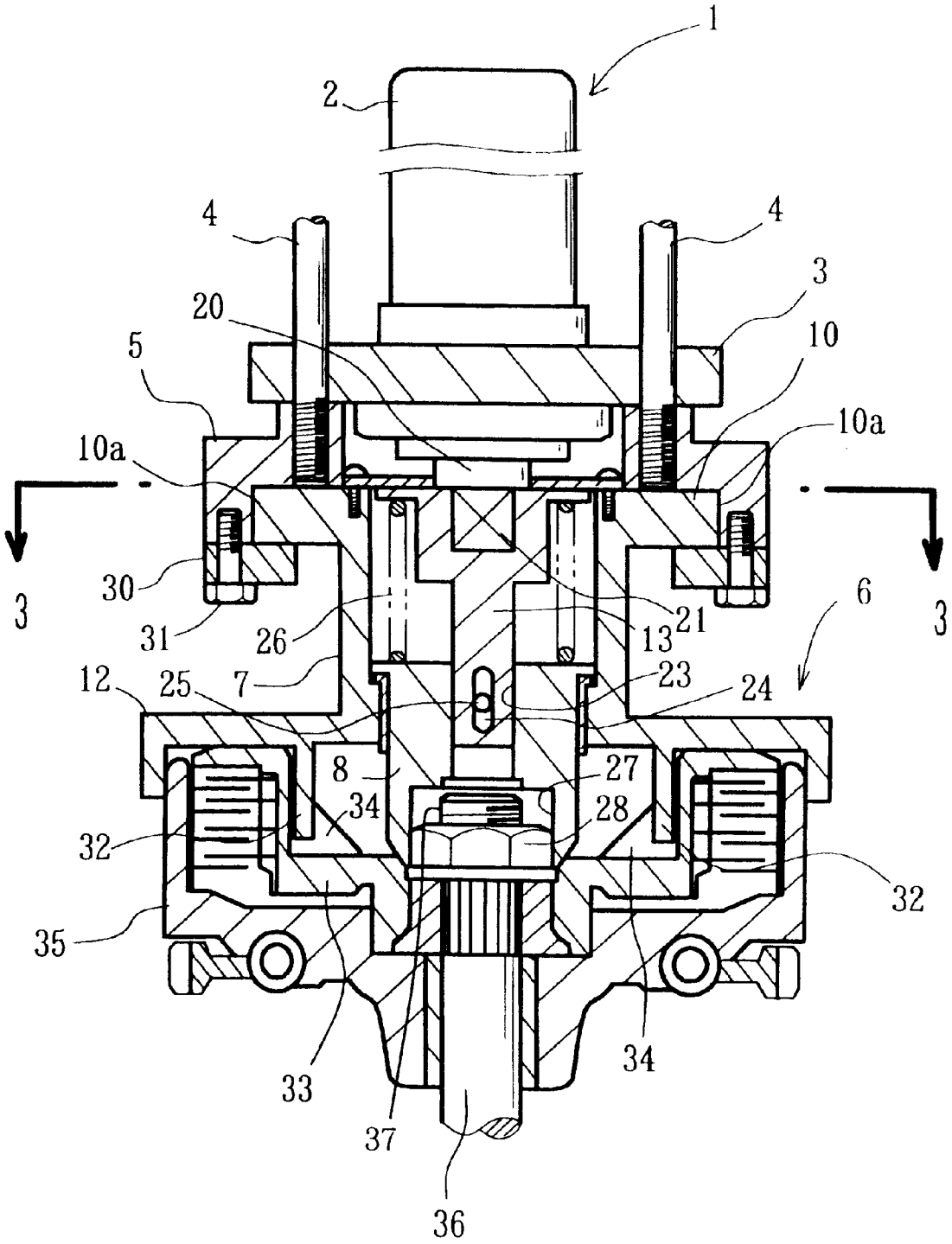
FIG. 1 is a sectional view of a fastening device at work according to the present invention.
Figure 2:
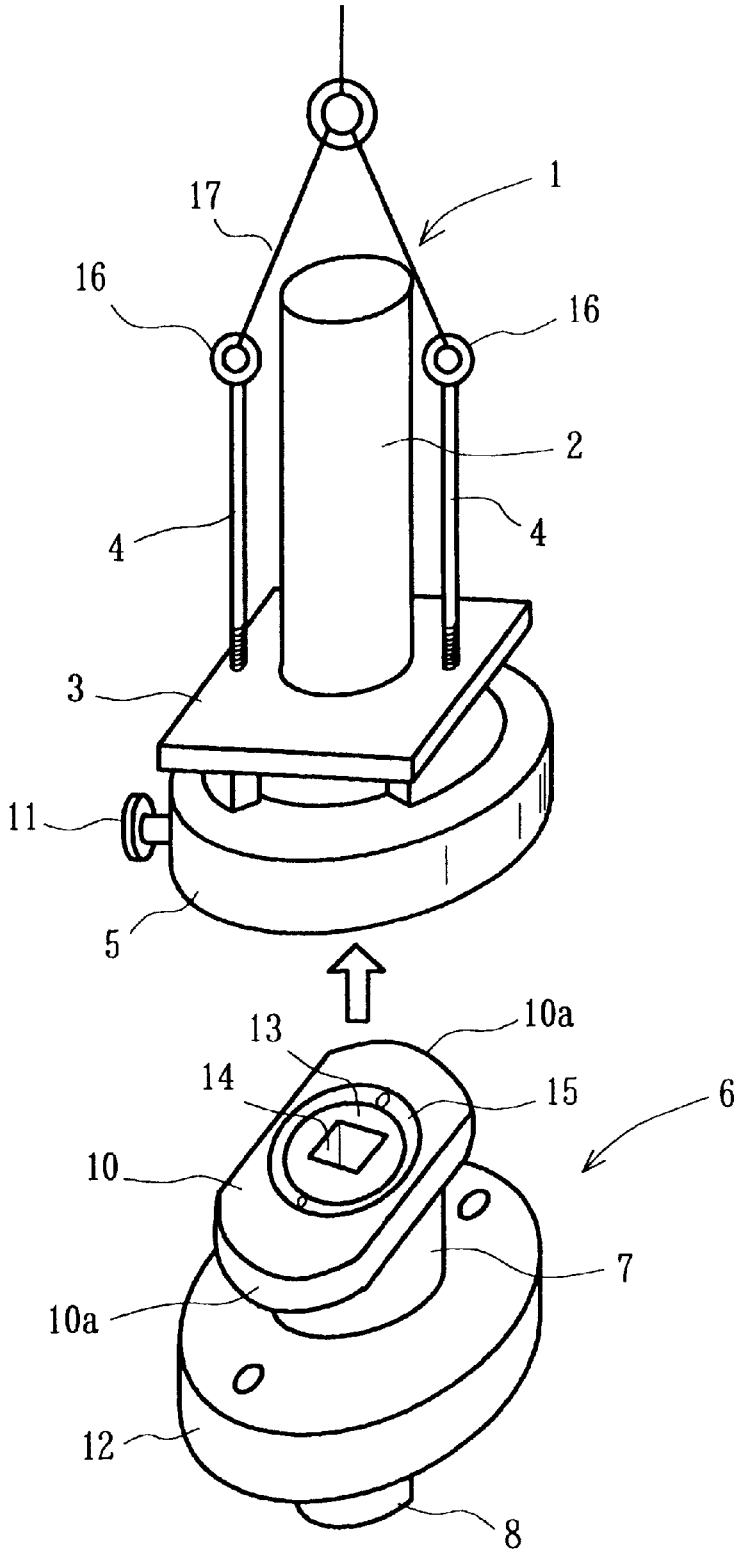
FIG. 2 is a disassembled perspective view of the whole apparatus.
Figure 3:
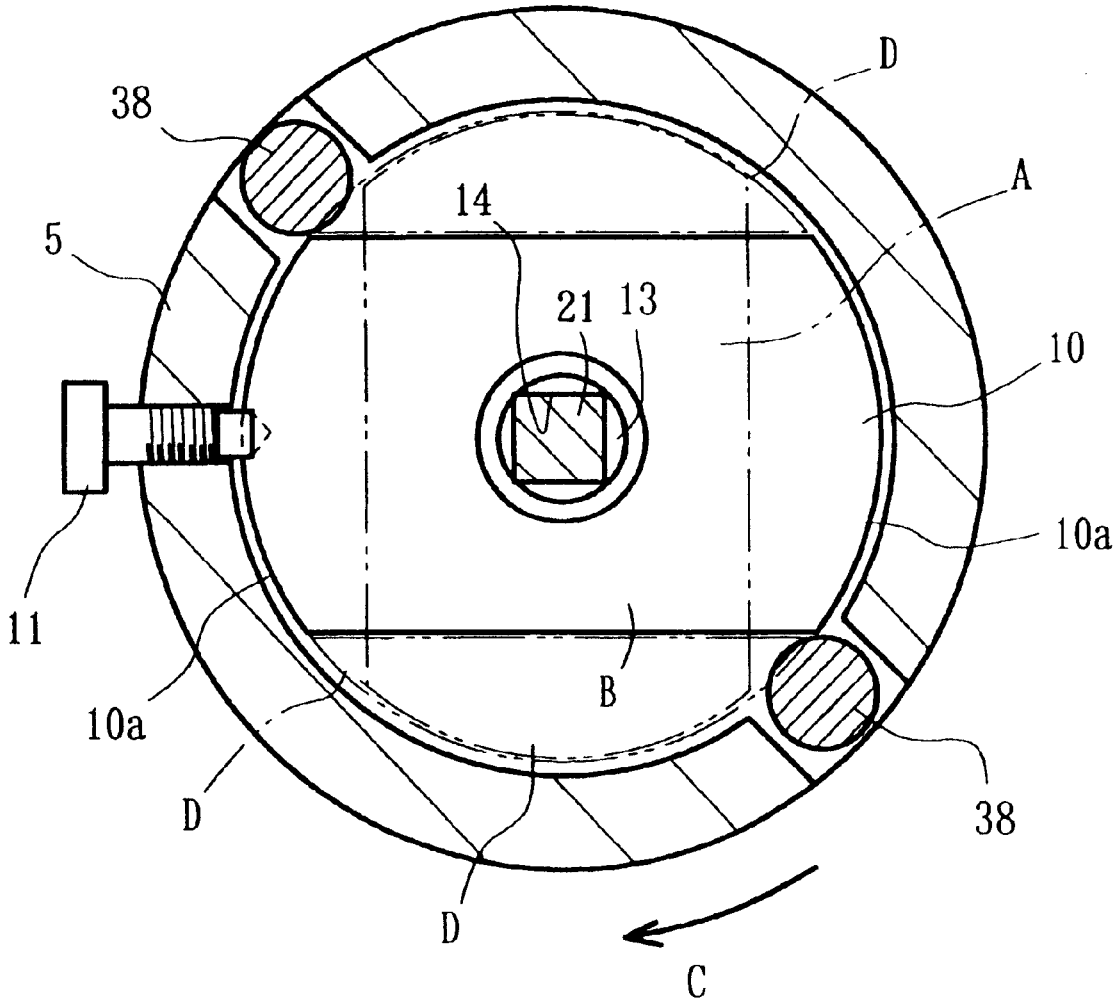
FIG. 3 is a brief sectional view taken along the line 3—3 in FIG. 1.

A preferred embodiment of the present invention applied to a fastening device to be used for assembling a clutch is illustrated with reference to the accompanying drawings, wherein FIG. 1 is a sectional view in the assembled condition of use, FIG. 2 is a disassembled perspective view of the fastening device, and FIG. 3 is a brief sectional view taken along the line 3—3 in FIG. 1.

First, the whole structure is roughly described by FIG. 2. This fastening device is equipped with an impact wrench 1 which is a fastener driving means, an impact wrench body 2 which is a driving body thereof, a jig holder 5 to be freely detachably fitted to a flange 3 which is integrated with the impact wrench body 2 with a bolt 4, and a socket integrated type whirl-stop jig 6 to be freely detachably fitted to the jig holder 5.

The socket integrated type whirl-stop jig 6 is equipped with a whirl-stop jig body 7 and a socket 8 to be supported in freely rotatable condition in the inside thereof. The whirl-stop jig body 7 is integrated with the jig holder 5 by engaging an approximately elliptical shaped joint 10 provided at its top end and fastening it with a bolt 11. Also, at the lower part of the whirl-stop jig body 7, a large diameter flange 12 is provided.

On the other hand, the socket 8 is coupled with a coupling member 13 an end of which faces the joint 10, and is rotatable in one-piece with it, so that it is linked with the rotating driving part on the impact wrench 1 through a square hole 14 provided on the coupling member 13. The part 15 is a press ring.

This fastening device is suspended to be freely movable up and down with respect to the upper part of a work table or the like by connecting a loop 16 provided at the top end of the bolt 4 with a suspension jig 17.

Next, detailed structure is illustrated by FIGS. 1 and 3. The impact wrench 1 is equipped with a rotary shaft 20 which is a rotary driving part supported in a freely rotatable manner on the impact wrench body 2, so that, when a square shaped part 21 formed at a tip of the rotary shaft 20 is detachably engaged with the square hole 14 of the coupling member 13, the rotary shaft 20 and the coupling member 13 rotate in one-piece.

The other end of the coupling member 13 is engaged with a shaft hole 23 formed at an end of the socket 8 in a freely advancing and retreating manner. The coupling member 13 and the socket 8 are relatively movable in an axial direction and rotatable in one-piece by means of a slot 24 which is formed in an axial direction of the coupling member 13 and a pin 25 which is led through the socket 8. Between the coupling member 13 and the socket 8 a coil spring 26 is interposed in compression to force by use of the spring the socket 8 in the forward projecting direction.

At the other end of the socket 8, there is formed a cavity or concave 27 for engaging a hexagonal fastener 28 comprising a bolt or nut (in this embodiment, the nut). The fastener 28 is connected to a screw of the counterpart by rotating in one-piece with the socket 8.

The whirl-stop jig body 7 has a hollow tubular shape in order to accommodate rotational components such as the socket 8, the coupling member 13 and the coil spring 26 and the like. The flange shaped joint 10 formed on the upper part of the jig body 7 is engaged in the jig holder 5 having nearly a cup form, and is fixedly supported to the jig holder 5 with a bolt 31 through a press plate 30.

To a suitable place of the flange 12 formed at the other lower end of the whirl-stop jig body 7, an integral baffle 32 of pin form is formed in projection in parallel with the direction of rotation, and is to be engaged with a rib 34 which is formed in one-piece with a clutch inner part 33 which is a member to be fixed.

The clutch inner part 33 and a clutch outer part 35 are both engaged with the shaft end of a rotary shaft 36, in which the clutch inner part 33 is fixed by serration to the rotary shaft 36 to rotate in one-piece therewith by tightening the fastener 28 to a screw part 37 formed at an end of the rotary shaft 36.

FIG. 3 shows a reaction force receiving structure wherein there are provided at the 180 degree symmetric positions of the jig holder 5 a pair of reaction force receiving pins 38 forming reaction force receiving parts in a manner to interfere with a largest diameter portion 10*a* of the joint 10. In the case the jig holder 5 engages the joint 10, at first the joint 10 is positioned in a condition shown in an imaginary line A. Then, by rotating the joint 10 by approximately 90 degrees in a direction indicated by an arrow mark C which is a direction of rotation at the time of fastening, the joint 10 reaches the position shown by a real line B in which the largest diameter portion 10*a* interferes with the reaction force receiving pin 38. At that position, the jig holder 5 and the joint 10 are fixed by the bolt 11.

The operation of the present embodiment will be explained hereunder. In FIG. 1, when the fastening device is positioned above the clutch , the fastener 28 is set on the tip of the screw 37, and the axial line of the rotary shaft 36 and the axial line of the socket 8 are set in alignment with each other. Then, the whole apparatus previously suspended is lowered, and the fastener 28 is engaged within the concave portion 27 of the socket 8, is that upon rotation of the rotary shaft 20 of the impact wrench 1 the fastener 28 is tightened by the socket 8.

At this time, while the clutch inner part 33 is integrated with the rotary shaft 36 in freely rotatable condition, due to the engagement of the baffle 32 with the rib 34, the clutch inner part 33 is whirl-stopped, and the whirl-stop jig body 7, jig holder 5 and impact wrench body 2 are integrated as a non-rotating part.

In view of the above, in the fastening operation of the fastener 28 by the socket 8, since the fastening device does not necessitate the use of the separate whirl-stop tool, the operation can be performed solely with the fastening device, thereby improving the work efficiency.

On completion of tightening the fastener 28, the rotation of the fastener 28 is stopped, and its reaction force is transmitted to the coupling region between the jig holder 5 and the joint part 10 of the whirl-stop jig body 7 through the socket 8, coupling member 13, rotary shaft 20 and impact wrench body 2, so as to be sustained there by the reaction force receiving pin 38.

Also, by connecting the rotary shaft 20 and the socket 8 through the coupling member 13, the socket 8 can be relatively shifted in the axial direction with respect to the coupling member 13, so that, even if the position of the fastener 28 changes during tightening, the change can be favorably followed by the coil spring 26, and that even if the position of the screw part 37 changes due to the difference of the objects to be fixed, the matter can be elastically met by the change of the projection amount of the socket 8, thereby obtaining universal applicability.

Furthermore, since the socket integral whirl-stop jig 6 is formed separately and detachably with respect to the jig holder 5, the difference of in the object to be fixed and the change in the structure and position of the whirl-stop can be readily met by simply replacing the whirl-stop jig body 7.

That is to say, for the objects to be fixed such as a flywheel which is previously provided with stopping holes to be engaged, there is selectively employed a whirl-stop jig body 7 provided with the whirl-stop part which is capable of engaging the stopping holes. Also, when the size and position of the stopping hole are changed by the difference of the kind of apparatus or the like, another whirl-stop jig body 7 may be employed in the similar manner.

Furthermore, in the case a convex portion is provided on the object to be fixed, a concave part to engage it may be provided on the whirl-stop jig body 7 to be used as a whirl-stop part, and if the objects to be fixed has a square part such as a gear, then a hollow concave part having a serration for engaging it may be provided.

As described above, it is possible to meet the extensive range of the objects to be fixed by simply replacing not the whole fastening device but the whirl-stop jig body 7 only, which is a relatively small sized and low priced part. Accordingly, as a whole, the fastening device has rich universal applicability of use.

It is to be noted here that the present invention is not limited to the illustrated embodiment but may be applied in various modifications and applications, and for example an impact wrench 1 may be another type of electromotive tool or the like. In the case the fastening device is formed such that the fastening operation can be effected not in one direction only but in any direction, a pair of semi-circular shaped reaction force receiving members as shown in the imaginary line D in FIG. 3 may be used.

What is claimed is:

1. A fastening device wherein a member to be fixed is engaged with a shaft end of a rotary shaft and fixed thereto by a fastener comprising;

a fastener driving means having a rotary driving part and a driving body which rotatably supports said rotary driving part;

a whirl-stop jig which is integrally provided with a socket;

said whirl-stop jig having a tubular jig body detachably fitted to said driving body and said socket rotatably supported in said tubular jig body;

said whirl-stop jig body provided with a whirl-stop for holding the member to be fixed in a non-rotational manner; and said socket cooperatively connected at an end thereof to said rotary driving part to rotate therewith and provided on another end thereof with a coupling portion for the fastener.

2. The fastening device according to claim 1, wherein said socket is connected to a rotary driving shaft of said rotary driving part through a coupling member, wherein said coupling member and said socket are connected in a manner to be rotatable in one-piece and relatively movable in an axial direction, and wherein said socket is forced to project forward by a spring interposed between said coupling member and another end.

3. The fastening device according to claim 1, wherein said whirl-stop jig body is fitted to a jig holder which is previously fitted to said driving body in freely rotatable manner, and wherein a reaction force receiving part for receiving a reaction force of said fastener driving means is provided on said jig holder.

4. The fastening device according to claim 1, wherein said whirl-stop is formed into a cavity in which a part provided on the member to be fixed is engaged.

5. The fastening device according to claim 1, wherein said whirl-stop is formed to be engaged with a rib provided on the member to be fixed.

6. The fastening device according to claim 1, wherein said whirl-stop is formed into a hollow member.

* * * * *